US010760350B2

(12) United States Patent
Anderson

(10) Patent No.: US 10,760,350 B2
(45) Date of Patent: Sep. 1, 2020

(54) SUBMERSIBLE PUMP CABLE CONNECTOR ASSEMBLY

(71) Applicant: David Martin Anderson, Long Beach, CA (US)

(72) Inventor: David Martin Anderson, Long Beach, CA (US)

(73) Assignee: Taurus Engineering, Inc., Long Beach, CA (US)

( * ) Notice: Subject to any disclaimer, the term of this patent is extended or adjusted under 35 U.S.C. 154(b) by 154 days.

(21) Appl. No.: 16/144,183

(22) Filed: Sep. 27, 2018

(65) Prior Publication Data

US 2020/0102796 A1 Apr. 2, 2020

(51) Int. Cl.

| | |
|---|---|
| ***H01R 13/52*** | (2006.01) |
| ***E21B 17/02*** | (2006.01) |
| ***E21B 17/10*** | (2006.01) |
| ***E21B 33/04*** | (2006.01) |
| ***E21B 43/12*** | (2006.01) |
| *H01R 13/523* | (2006.01) |

(52) U.S. Cl.

CPC ..... *E21B 17/028* (2013.01); *E21B 17/1035* (2013.01); *E21B 33/0407* (2013.01); *E21B 43/128* (2013.01); *H01R 13/523* (2013.01)

(58) Field of Classification Search

CPC .... H01R 13/52; H01R 13/523; H01R 13/533; H01R 13/5202; H01R 13/5205; H01R 13/5208; E21B 17/028; E21B 43/128

See application file for complete search history.

(56) References Cited

U.S. PATENT DOCUMENTS

| | | | | |
|---|---|---|---|---|
| 7,575,458 | B2 * | 8/2009 | Parmeter | H01R 13/521 439/271 |
| 7,666,013 | B1 * | 2/2010 | Kopecky | F04D 13/10 417/423.3 |
| 7,789,689 | B2 * | 9/2010 | Frey | H01R 13/523 439/275 |
| 7,980,873 | B2 * | 7/2011 | Emerson | E21B 43/128 174/84 R |
| 9,941,622 | B1 * | 4/2018 | Campbell | H01R 13/005 |
| 10,326,215 | B1 * | 6/2019 | Anderson | H01B 7/046 |
| 2018/0094492 | A1 * | 4/2018 | Knapp | E21B 17/003 |

* cited by examiner

*Primary Examiner* — Xuong M Chung Trans

(74) *Attorney, Agent, or Firm* — Dunlap Bennett & Ludwig, PLLC; Brendan E. Squire

(57) ABSTRACT

A field attachable submersible pump cable connector assembly for an electrical connection in a well head, allowing for direct connector assembly to the ESP cable eliminating the cable to cable splice. The connector assembly permits the use of standard crimping pliers to crimp the ends of a heavy gauge multi-conductor cables typically used for electric submersible pump (ESP) cables to the power pin for connection to an electrical power source external to the well head. The connector assembly protects the crimped connection from contaminants and the corrosive environment within the well head.

15 Claims, 7 Drawing Sheets

SUBMERSIBLE PUMP CABLE CONNECTOR ASSEMBLY

BACKGROUND OF THE INVENTION

The present invention relates to electrical connectors, and more particularly to electrical connectors for submersible electric pumps.

In the oil and gas industry, submersible electric pumps are utilized to pump crude oil from within the well head. The environment within the well head in which the pumps and associated electrical conductors operate makes the electrical connections within the wellhead susceptible to corrosion, fatigue, and ultimately disruption of electrical conduction necessary to operate the pumps. The conductors within the well head must also effectively routed to the exterior of the well head to permit connection to an external power source outside to operate the pump.

From time to time, the conductor cables within the well head may require repair or replacement. At other times, the pump may be relocated to a different well head and the conductor cables may be replaced as a precaution to accomplish a fresh installation. The repairs will typically require a splice connection of the conductors. The individual conductors within the heavy gauge multi-conductor cables, typically electrical submersible pump (ESP) cables, are normally oriented in flat side by side configuration. Due to the heavy gauge, the individual conductors in the cables are typically very rigid. Accordingly, adequate separation of the conductors is needed in order to apply a splice with conventional splicing tools.

Once the splice is accomplished, it is important to maintain separation of the spliced connections while sealing the spliced connections for protection from the severe environmental conditions within the well head.

As can be seen, there is a need for an improved connector for sealing the electrical conductors within the well head and providing for an exterior connection to an external power source.

SUMMARY OF THE INVENTION

In one aspect of the present invention an electrical connector assembly for a wellhead is disclosed. The connector assembly includes an elongate cartridge, having a top end, a bottom end, and an interior cavity defined between the top end and the bottom end that is configured to contain a splice connection between a multi-stranded ESP conductor carried in a well bore and a plurality of power pins extending from a top end of the cartridge external to the well head. A resilient bottom seal has an elongate slot dimensioned to receive an outer sleeve of the multi-stranded ESP conductor and an exterior dimension to resiliently engage with a wall of the interior cavity. A retainer block and a pressure block configured to be received in an intermediate portion of the cartridge, the retainer block and the pressure block having an axially aligned aperture to carry each of the plurality of power pins in a spaced apart relation within the interior cavity. A splice chamber is defined between the retainer block and the bottom seal.

The electrical connector assembly may also include a boot configured to be sealingly received in the top end of the of the elongate cartridge, the boot having a bore to receive each of the plurality of power pins in a radial disposition about a longitudinal axis of the cartridge. A power pin chamber is defined between the boot and the pressure block. The power pin chamber is adapted to carry the plurality of power pins in a spaced apart relation.

A restrictor rotationally restricts the movement of the power pins within the interior cavity. In some embodiments, the restrictor may include one or more set screws that are received through the wall of the elongate cartridge and received in one or more of the pressure block and the retaining block. In other embodiments, the restrictor may be a keyed slot defined in one of the pressure block and the retaining block and a corresponding protrusion extending from the wall of the interior cavity.

The length of the power pin chamber corresponds to a length of the plurality of power pins selected for the well head. The cartridge may also include at least one injection aperture defined in the wall of the cartridge. The injection aperture is dimensioned to receive an injection tip of a potting material injector.

In other embodiments, a seal sleeve is adjustably positionable along a length of the top end of the cartridge. An annular groove inscribing an interior surface of the seal sleeve is configured to receive an O-ring for sealing engagement with an exterior wall of the cartridge. Likewise, an annular groove circumscribing an exterior surface of the seal sleeve is configured to receive an O-ring for sealing engagement with a bore of the well head. The seal sleeve may also include an annular lip circumscribing the exterior surface of the seal sleeve. The annular lip is configured as a stop to engage a top end of the bore of the well head.

In some embodiments, a top stub is secured to the top end of the cartridge. The top stub includes an annular groove inscribing an interior surface of the top stub that configured to receive an O-ring for sealing engagement with an exterior wall of the cartridge. Preferably, the top stub has a length at least as long as a terminal end of the plurality of power pins extending from the top end of the cartridge. The top stub is configured to receive a cannon plug connection to a power supply.

In other embodiments, the cartridge has an alignment indicator defined on an exterior surface indicating an alignment of the power pins carried within the cartridge. In yet other embodiments, a potting material is received within the power pin chamber.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
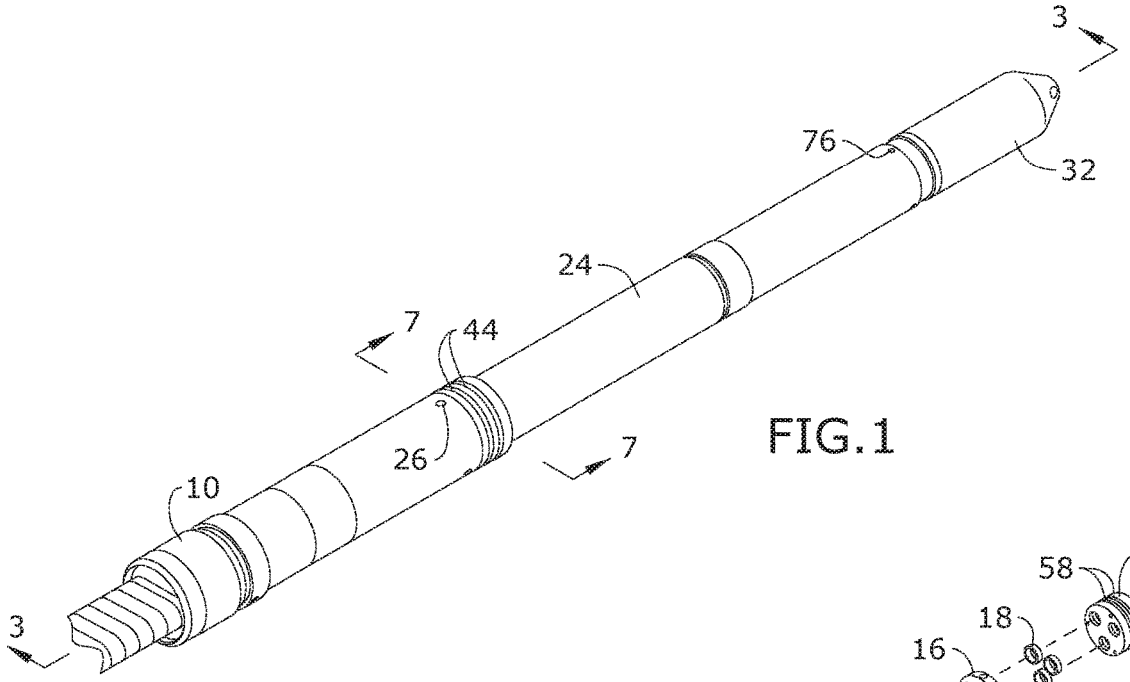
FIG. 1 is a perspective view of the cable connector, shown assembled with bullnose protector 32 and pre-crimped flat ESP cable 52 in place.
Figure 2:
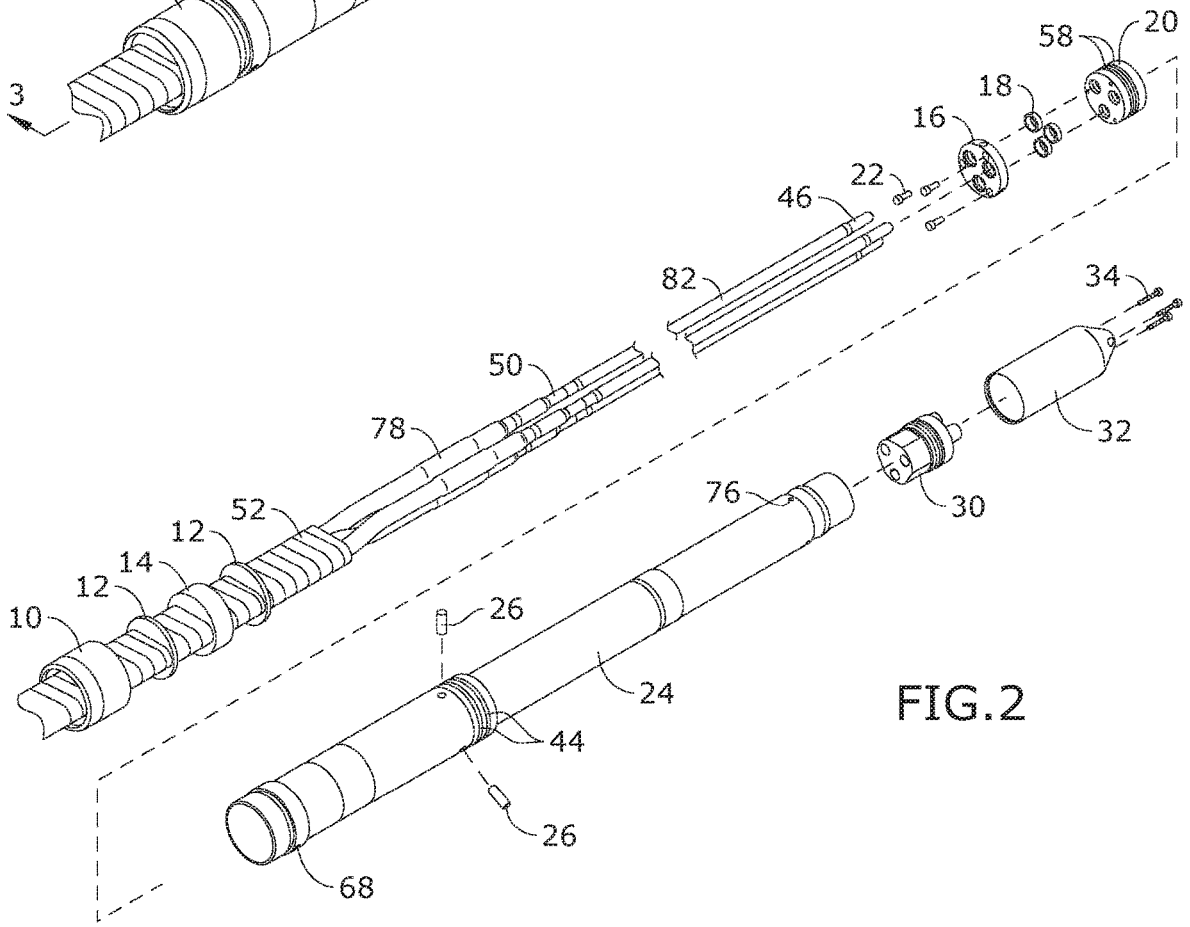
FIG. 2 is an exploded view of the connector, with barrier assembly parts preset onto ESP cable 52.

Broadly, embodiments of the present invention provide an improved electrical connector for an electrical pump conductor installation in a well head. As seen in reference to the drawings of FIGS. 1-3, the connector includes an elongate body, or cartridge 24, that is preferably formed of a durable rigid material, such as stainless steel. The cartridge 24 has an interior cavity for containing a connection end of a stranded ESP conductor 52. The conductor 52 extends between the well pump and the interior cavity. A bottom seal carries the conductor 52 and seals the interior cavity of the cartridge 24 from infiltration of contaminants from within the wellhead 90. A retainer block 16 and pressure block 20 are positioned at an intermediate portion of the cartridge 24 provides separation of the conductor strands 54 and the power pins 46 within the cartridge 24. A splice chamber is defined at a down hole end of the cartridge 24 between the bottom seal and the pressure and retainer blocks 26, 20. A power pin chamber is defined between the pressure block 20 and a top seal 30 and is dimensioned to carry a plurality of power pins 48 between the splice chamber and the exterior of the well head 90.

As best seen in reference to FIGS. 3, 4, 6, and 9, the bottom seal includes a barrier nut 10 and a barrier plate 12 disposed on opposite sides of a barrier 14. The barrier plate 12 and the barrier 14 have an elongate slot formed therein that is dimensioned to closely conform to the outer protective sleeve of the ESP cable 52. The barrier nut 10 is configured to threadingly engage with a bottom end of the cartridge 24. The barrier plates 12 compress the barrier 14 between the bottom end of the cartridge 24 and an interior of the barrier nut 10 as the barrier nut is tightened to the end of the cartridge 24 to seal the end of the cartridge 24 and prevent infiltration of contaminants around the outer protective sleeve of the ESP cable 52. The barrier 14 may be formed of a rubber or elastomeric material, while the barrier plate 12 may be formed of a rigid material, preferably stainless steel. The barrier plate 12 is dimensioned to abut a mechanical shoulder defined in an end of the elongate cartridge 24. For higher pressure applications, a reinforced barrier plate 12 may include a plurality of barrier plates 12 on a down hole end of the connector 10. Alternatively, the thickness of the barrier plate 12 may be increased.

As best seen in reference to FIGS. 2, 3, 4, and 9, each strand of the ESP cable 52 includes a conductor 54 that is surrounded by an insulating layer 50. Each conductor 54 is joined to a power pin 48 by a splice 48 that is crimped around the joined ends thereof and is contained within the interior cavity at an intermediate position between the top end and the bottom end of the cartridge 24. The length of the cartridge 24 may be varied to correspond to a length of the power pin 48 that is spliced to the conductor 54. A high temperature tape wrap 80 may be utilized to cover the joined ends of the conductor 54 and the power pins 46 and their respective insulating layers. Likewise, a high modulus tape wrap 78 may be applied around the high temperature tape wrap 80.

A retaining block 16 has a plurality of bores defined in a spaced apart relation through the retaining block 16. Each bore receives a power pin 48 and maintains the power pins 48 in a spaced apart relation. The retaining block 16 is received within the cartridge 24 and is retained in place via a plurality fasteners, such as the retaining block set screws 26 so that the retaining block 16, and the conductors carried by the retaining block 16 are rotationally locked to prevent twisting of the conductors. Alternatively, the retaining block 16 and/or the pressure block 20 may be configured with a keyway or slot to align with a corresponding protrusion on an interior of the cartridge 24.

Because the conductors 54 and power pins 46 are concealed within the assembly, rotationally locking the conductors 54 ensures proper alignment of the power pins 46 relative to an external indicator 76 so that the power pins 46 can be connected to the electrical power source.

Likewise, maintaining the alignment of the ends of the power pins 46 and their axial position ensures that the power pins 46 each make a sound electrical connection with the connector to the electrical power source. An adjacent face (in an up whole direction) of the retaining block 16 has a shouldered recess defined within each of the retaining block bores. The shouldered recess receives a retaining device 18, such as a clamp, clip, or ring that clamps into a gap in the insulation of the power pin polyetheretherketone (PEEK). The retaining devices 18 are secured between the pressure block 20 and the retaining block 16 to axially secure the power pins 46. An epoxy bonding agent may be positioned in proximity to the splice 48.

Figure 4:
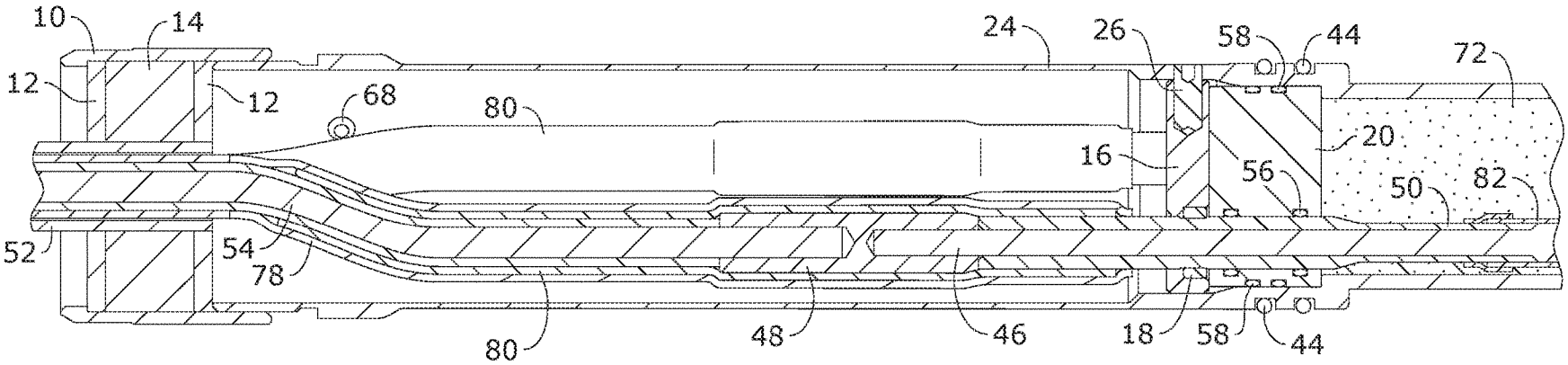
FIG. 4 is a detail section view of the connector.
Figure 9:
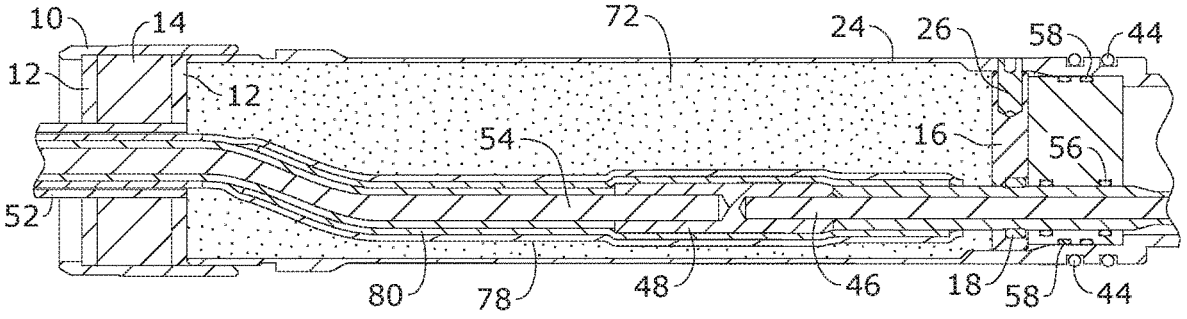
FIG. 9 is a detail section view of the connector with potting compound 72 in place.
Figure 10:
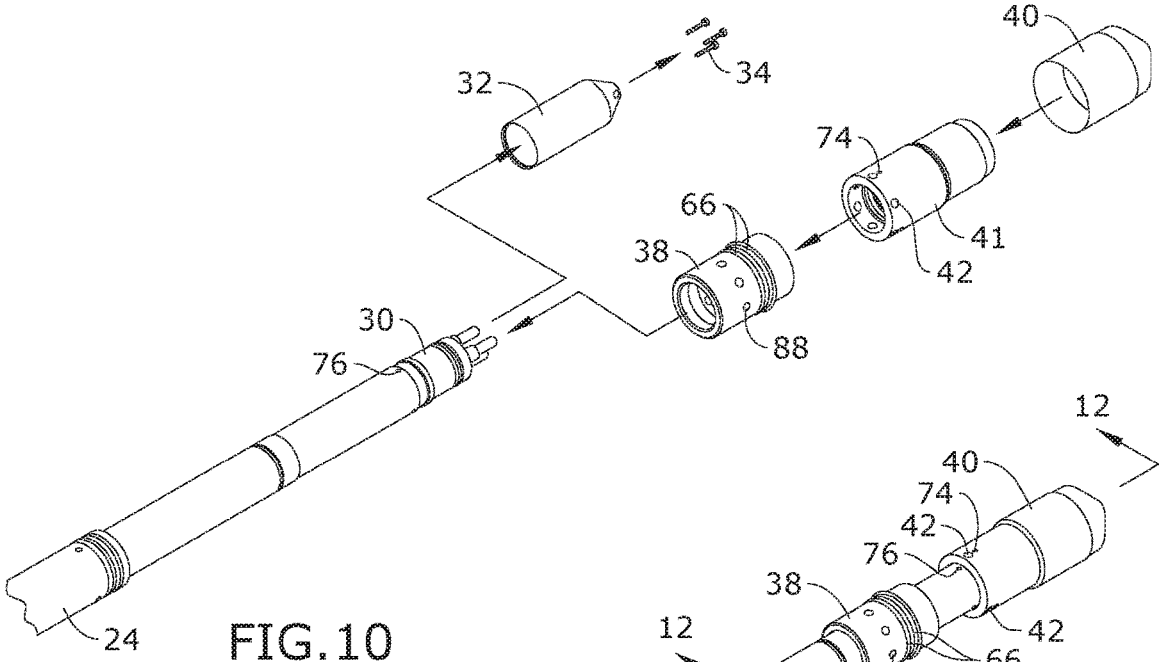
FIG. 10 is a perspective view of the connector, illustrating the removal of bull nose protector 32 in order to install seal sleeve 38 and top sub 40.
Figure 11:
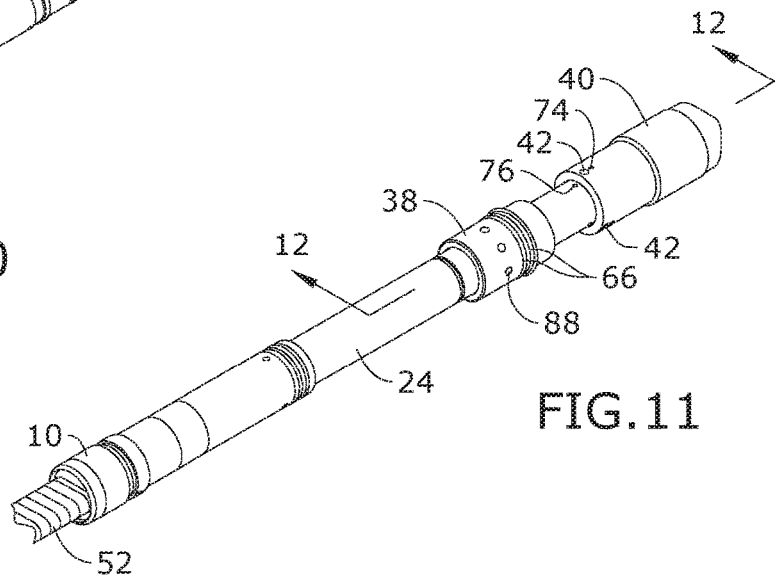
FIG. 11 is a perspective view of the connector, shown assembled with seal sleeve 38 and top sub 40.

As best seen in reference to FIGS. 4 and 9, a pressure block 20 has a plurality of bores defined in a spaced apart relation, coaxially aligned with the bores in the retaining block 16. Each pressure block bore has at least one inner pressure block O-ring 56 to sealingly engage with an outer surface of the power pin 46. An outer surface of the pressure block 20 has at least one outer pressure block O-ring 56 that is received within an annular groove surrounding the pressure block 20. The pressure block 20 and outer pressure block O-ring 56 are dimensioned for sealing engagement with an interior wall of the cartridge 24. An up hole face of the pressure block 20 is positioned against an annular shoulder defined within the cartridge 24 at the pressure block.

At least one cartridge O-ring 44 is received in a channel circumscribing an exterior surface of the cartridge 24 proximal to the pressure block 20. The cartridge O-ring 44 is dimensioned for sealing engagement of the cartridge 24 within an internal bore of the wellhead 90.

Figure 3:
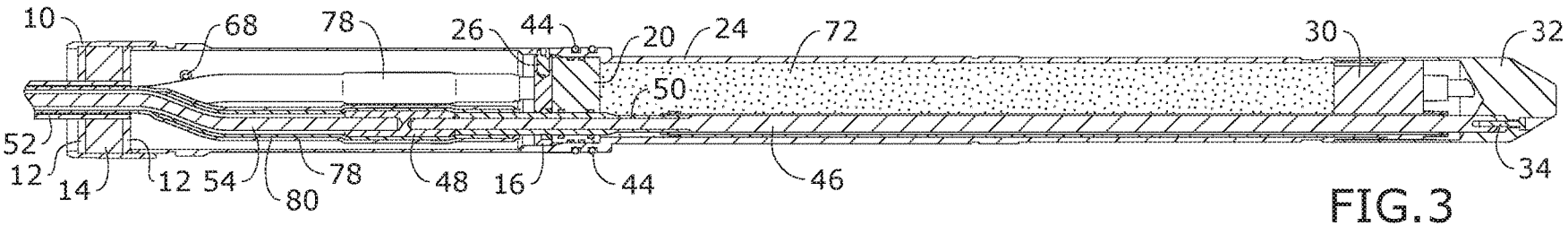
FIG. 3 is a section view of the connector, taken along line 3-3 in FIG. 1.
Figure 5:
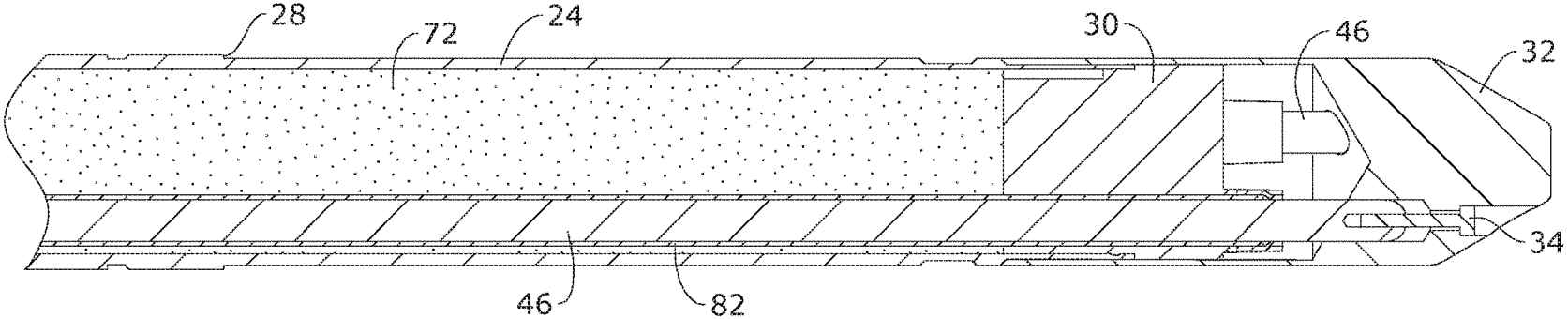
FIG. 5 is a detail section view of the connector.
Figure 6:
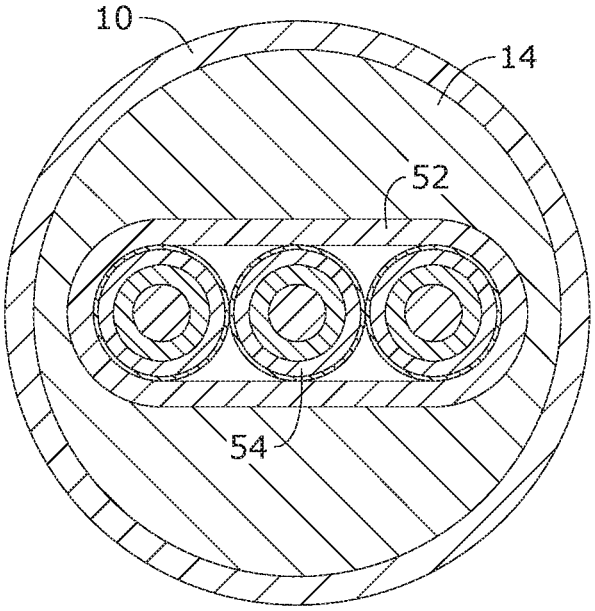
FIG. 6 is a section view of the connector, taken along line 3-3 in FIG. 1.
Figure 7:
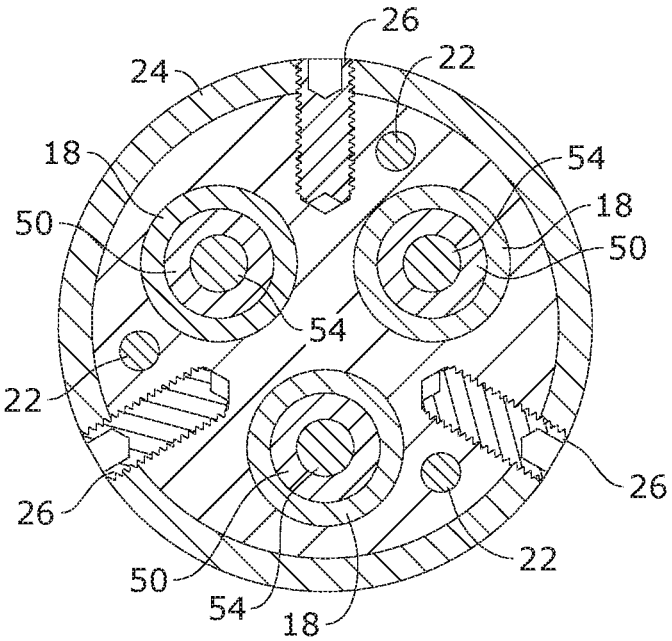
FIG. 7 is a section view of the connector, taken along line 7-7 in FIG. 1.
Figure 12:
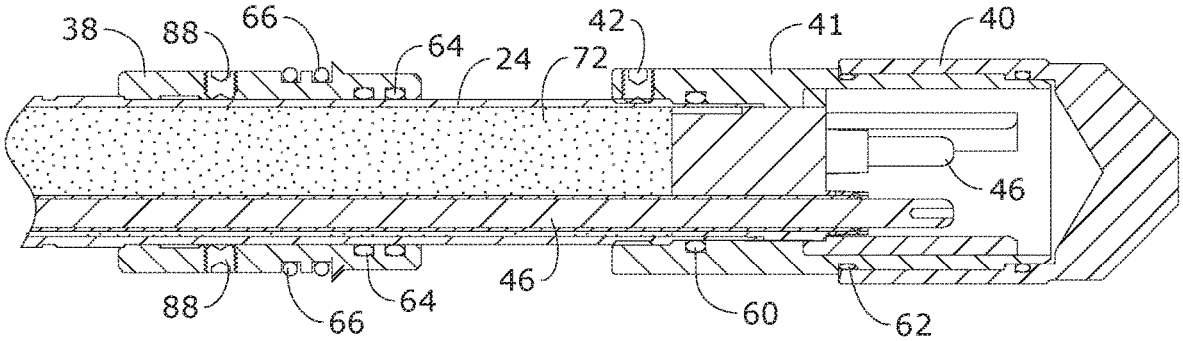
FIG. 12 is a section view of the connector, taken along line 12-12 in FIG. 11.
Figure 13:
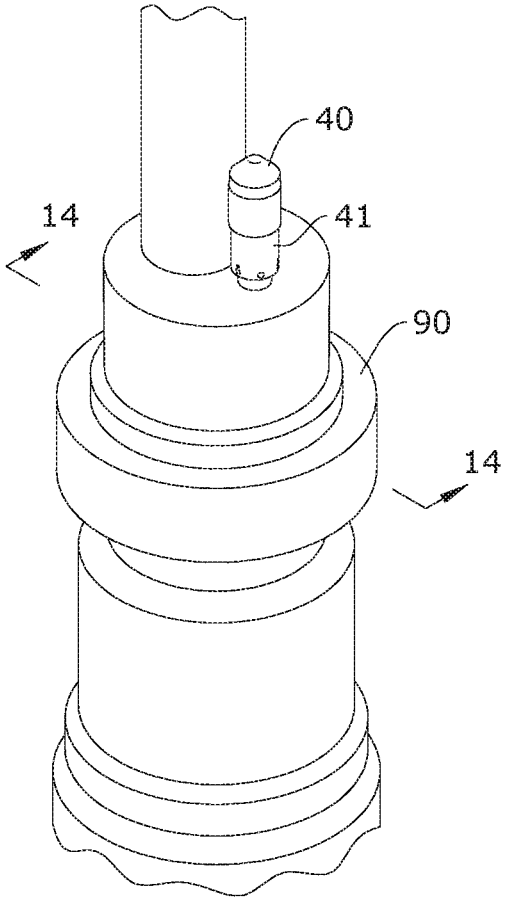
FIG. 13 is a perspective view of the connector, shown installed in a wellhead.
Figure 14:
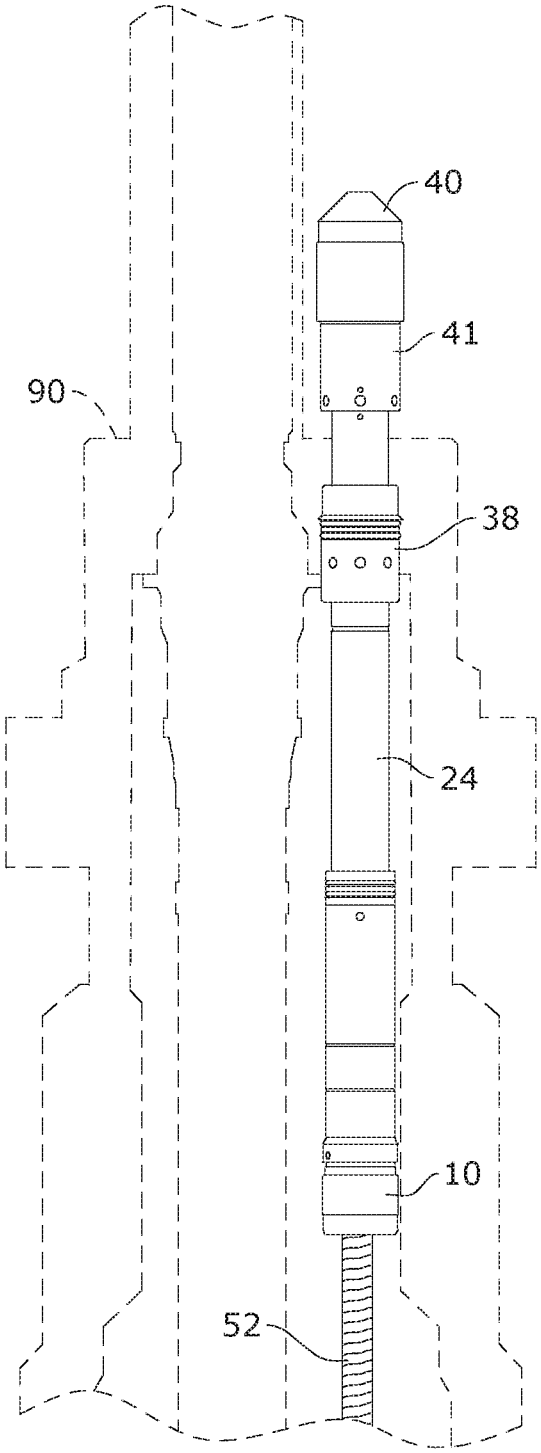
FIG. 14 is a schematic section view of the connector, taken along line 14-14 in FIG. 13, with the connector shown in full and the wellhead components shown as hidden for clarity.
Figure 15:
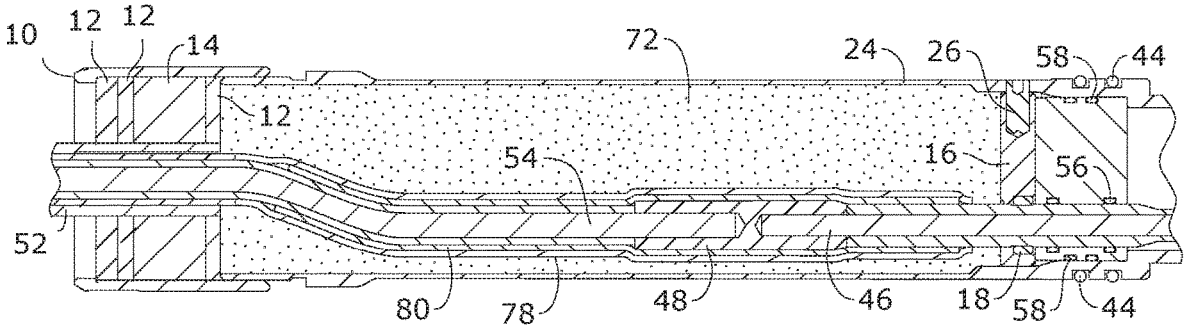
FIG. 15 is a detail sectional view of the connector with a barrier reinforcement.

As best seen in reference to FIGS. 3, 5, and 12, an upper end of cartridge 24 extends from the pressure block 16 to the terminal end of the cartridge 24. A rubber boot 30 has a plurality of bores through which the power pins 46 extend. The boot is dimensioned to be received within the end of the cartridge 24. The power pins 46 extend through the rubber boot 30.

A seal sleeve is 38 is received around the upper end of the cartridge 24. The seal sleeve 38 has inner sleeve O-rings 64 for mating engagement with an exterior surface of the cartridge 24. At least one outer sleeve O-ring 66 is carried in an annular groove circumscribing the sleeve. The outer sleeve O-ring 66 is dimensioned for sealing engagement with an aperture defined in a top end of the wellhead 90. The seal sleeve 38 has an aperture and set screw 88 for securement of the seal sleeve 38 to the cartridge 24 at a desired position within the wellhead 90.

A top stub 41 is received at the top end of the cartridge 24. The top stub 41 has an aperture and set screw 42 to secure the top stub 41 to the end of the cartridge 24. At least one annular channel on an interior surface of the top stub 41 receives an O-ring 60 for sealing engagement of the top stub 41 and the exterior wall of the cartridge 24. An annular channel is defined around an exterior wall of the top stub 41 and is configured to receive an external top stub O-ring for sealing engagement with a cannon plug connector 40 or protective endcap. The top stub 41 may also have one or more alignment marks 74 to provide a visual reference for alignment of the cannon plug connector 40 with the power pins 46 carried by the cartridge 24. Each power pin 48 is then carried through the top seal 30 to a point external of the wellhead 90. The power pin 48 may also have an insulating layer 82. A bullnose protector 32 may be provided to attach to the end of the cartridge 23 so that the external ends of the power pins 48 are protected from the elements. In use, the power pins 48 are connected to an electrical power source external of the wellhead 90.

Figure 8:
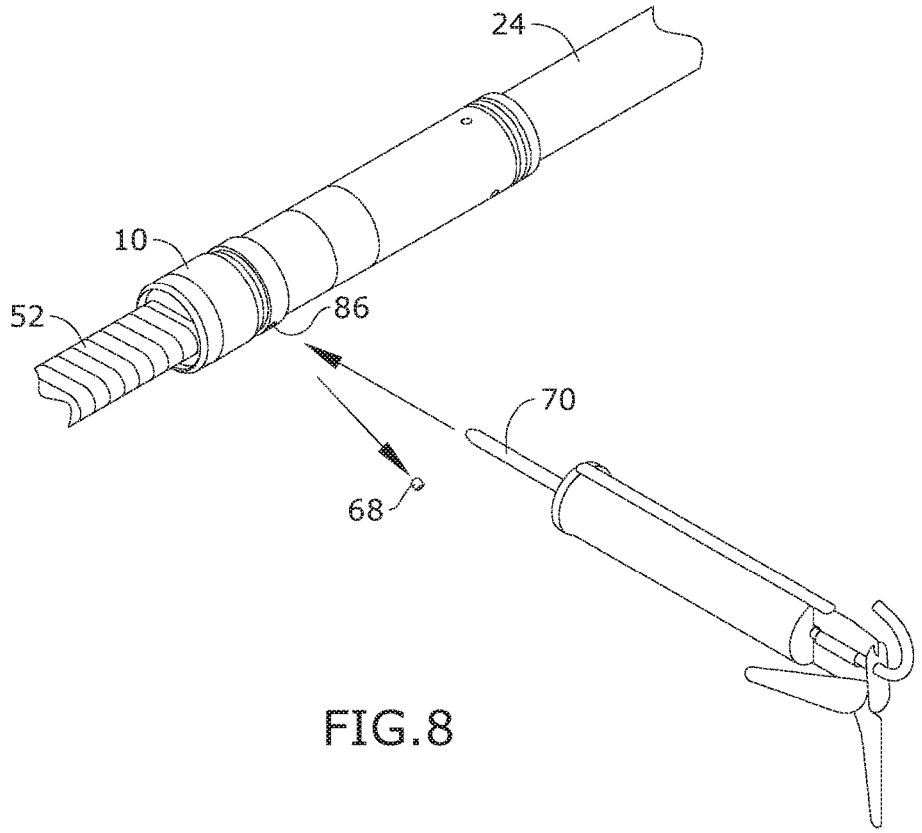
FIG. 8 is a detail perspective view of the connector, illustrating the removal of set screw 26 to insert potting compound injector 70.

As seen in reference to FIG. 8, the cartridge 24 includes one or more injection apertures 86 that allow for the injection of a potting compound 72 to the interior cavity of the cartridge 24. A set screw, or plug 68 may then be inserted into the aperture 86 to seal the potting compound 72 within the cartridge 24. In a field environment, the potting compound 72 may be injected with an injection gun 70.

It should be understood, of course, that the foregoing relates to exemplary embodiments of the invention and that modifications may be made without departing from the spirit and scope of the invention as set forth in the following claims.

What is claimed is:

1. An electrical connector assembly for a wellhead, comprising:

a field attachable elongate feed through cartridge, having a top end and a bottom end, and an interior cavity defined between the top end and the bottom end that is configured to contain a splice connection between a multi-conductor ESP cable carried in a well bore and a plurality of power pins extending into a top end of the cartridge assembly from external the well head;

a resilient bottom seal having a hole dimensioned to receive an outer layer of the multi-conductor ESP cable, and an exterior dimension to resiliently engage with a wall of the interior cavity when compressed by at least one barrier plate;

a retainer block and a pressure block configured to be received in an intermediate portion of the feed through cartridge, the retainer block and the pressure block having an axially aligned aperture to carry each of the plurality of power pins in a spaced apart relation within the interior cavity, the retainer block and pressure block securable within the feed through cartridge by a restrictor to rotationally lock the plurality of power pins in a selected orientation while the pressure block and retainer block axially lock the plurality of power pins in a selected axial orientation; and a splice chamber defined between the retainer block and the bottom seal.

2. The electrical connector assembly of claim 1, further comprising:

a mechanical shoulder defined at the bottom end of the feed through cartridge, wherein the at least one barrier plate abuts the mechanical shoulder.

3. The electrical connector assembly of claim 2, wherein the at least one barrier plate comprises:

a first barrier plate and a second barrier plate; and the resilient bottom seal is compressed between the first barrier plate and the second barrier plate.

4. The electrical connector assembly of claim 1, further comprising:

a boot configured to be sealingly received in the top end of the elongate cartridge, the boot having a bore to receive each of the plurality of power pins in a radial disposition about a longitudinal axis of the cartridge.

5. The electrical connector assembly of claim 1, wherein the pressure block and the retaining block are axially joined by a fastener.

6. The electrical connector assembly of claim 1, wherein restrictor comprises:

one or more set screws received through the wall of the elongate cartridge and received in one or more of the pressure block and the retaining block to rotationally lock the axially joined pressure block and retaining block.

7. The electrical connector assembly of claim 1, wherein the restrictor comprises:

a keyed slot defined in one of the pressure block and the retaining block; and a corresponding protrusion extending from the wall of the interior cavity, wherein engagement of the keyed slot with the protrusion to rotationally locks the axially joined pressure block and retaining block.

8. The electrical connector assembly of claim 1, further comprising:

at least one injection aperture defined in the wall, the injection aperture dimensioned to receive an injection tip of a potting material injector for injection of a potting material into the splice chamber.

9. The electrical connector assembly of claim 1, further comprising:

a threaded seal sleeve adjustably positionable along a length of the top end of the cartridge;

an annular groove inscribing an interior surface of the threaded seal sleeve configured to receive an O-ring for sealing engagement with an exterior wall of the cartridge; and an annular groove circumscribing an exterior surface of the threaded seal sleeve, the annular groove configured to receive an O-ring for sealing engagement with a bore of the well head.

10. The electrical connector assembly of claim 8, further comprising:

an annular lip circumscribing the exterior surface of the seal sleeve, the annular lip configured as a stop to engage a shoulder of the bore of the well head.

11. The electrical connector assembly of claim 1, further comprising:

a top stub secured to the top end of the cartridge;

an annular groove inscribing an interior surface of the top stub configured to receive an O-ring for sealing engagement with an exterior wall of the cartridge.

12. The electrical connector assembly of claim 10, wherein the top stub has a length at least as long as a terminal end of the plurality of power pins extending from the top end of the cartridge, the top stub configured to receive a cannon plug connection to a power supply.

13. The electrical connector assembly of claim 10, wherein the cartridge has an alignment indicator defined on an exterior surface indicating an alignment of the power pins carried within the cartridge.

14. The electrical connector assembly of claim 8, further comprising:

a potting material received within the splice chamber.

15. The electrical connector assembly of claim 1, further comprising:

a device configured to be received between the pressure block and the retaining block, the device having an inner diameter to be received in a gap along a length of the plurality of power pins, wherein the device locks the plurality of power pins in a selected axial alignment.

* * * * *